US009865962B2

(12) United States Patent
Zhao

(10) Patent No.: US 9,865,962 B2
(45) Date of Patent: Jan. 9, 2018

(54) ELECTRICAL CONNECTOR ASSEMBLY HAVING WATERPROOF FUNCTION AND METHOD OF MANUFACTURING THE SAME

(71) Applicant: Shenzhen Everwin Precision Technology Co., Ltd., Shenzhen (CN)

(72) Inventor: Huaguang Zhao, Shenzhen (CN)

(73) Assignee: SHENZHEN EVERWIN PRECISION TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/966,464

(22) Filed: Dec. 11, 2015

(65) Prior Publication Data

US 2016/0233606 A1 Aug. 11, 2016

(30) Foreign Application Priority Data

Feb. 6, 2015 (CN) ..... 2015 1 0061704
Feb. 6, 2015 (CN) ..... 2015 1 0061996

(51) Int. Cl.

| | |
|---|---|
| ***H01R 13/52*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/5202* (2013.01); *H01R 13/6585* (2013.01); *H01R 24/60* (2013.01); *H01R 2107/00* (2013.01)

(58) Field of Classification Search

CPC ..... H01R 13/5202; H01R 13/5216; H01R 13/5219; H01R 13/52

USPC ..... 439/936, 276, 589

See application file for complete search history.

(56) References Cited

U.S. PATENT DOCUMENTS

| | | | | |
|---|---|---|---|---|
| 7,878,852 | B2 * | 2/2011 | Hiew | G06K 19/077 439/607.01 |
| 7,922,535 | B1 * | 4/2011 | Jiang | H01R 13/5205 439/271 |
| 7,972,166 | B2 * | 7/2011 | Hiner | H01R 4/4818 174/76 |
| 8,388,380 | B1 * | 3/2013 | Van der Steen | H01R 13/5202 439/607.36 |
| 8,708,752 | B2 * | 4/2014 | Wu | H01R 9/032 439/660 |
| 9,022,800 | B2 * | 5/2015 | Yang | H01R 13/6581 439/487 |
| 9,231,356 | B1 * | 1/2016 | Ju | H01R 24/78 |
| 9,306,337 | B2 * | 4/2016 | Yu | H01R 24/60 |
| 9,350,126 | B2 * | 5/2016 | Little | H01R 24/60 |
| 9,444,199 | B2 * | 9/2016 | Leng | H01R 13/6596 |
| 2015/0044886 | A1 * | 2/2015 | Little | H01R 12/75 439/55 |
| 2015/0140868 | A1 * | 5/2015 | Do | H01R 24/62 439/676 |

(Continued)

*Primary Examiner* — Tulsidas C Patel
*Assistant Examiner* — Marcus Harcum
(74) *Attorney, Agent, or Firm* — Miles & Stockbridge P.C.

(57) ABSTRACT

The present invention relates to an electrical connector assembly comprising: an insulative housing; a plurality of terminals received into the insulative housing; metallic shell enclosing the insulative housing; and waterproof material sandwiched between the insulative housing and the metallic shell.

16 Claims, 15 Drawing Sheets

(56) References Cited

U.S. PATENT DOCUMENTS

| | | | | |
|---|---|---|---|---|
| 2015/0171562 | A1* | 6/2015 | Gao | H01R 13/6582 439/345 |
| 2015/0171574 | A1* | 6/2015 | Little | H01R 24/60 439/78 |
| 2015/0188263 | A1* | 7/2015 | Wu | H01R 24/64 439/607.55 |
| 2015/0236457 | A1* | 8/2015 | Hsu | H01R 13/6582 439/607.12 |
| 2015/0244111 | A1* | 8/2015 | Ju | H01R 13/6585 439/607.05 |
| 2016/0149337 | A1* | 5/2016 | Ozaki | H01R 13/73 439/529 |

* cited by examiner

ELECTRICAL CONNECTOR ASSEMBLY HAVING WATERPROOF FUNCTION AND METHOD OF MANUFACTURING THE SAME

This application claims priority to and benefits of Chinese Patent Application No. 201510061704.4 and Chinese Patent Application No. 201510061996.1, each of which was filed with the State Intellectual Property Office of P.R. China on Feb. 6, 2015, and the contents of each which is hereby incorporated by reference.

TECHNICAL FIELD

The present invention relates to an electrical connector assembly and method of manufacturing the same, and more particularly to an electrical connector assembly having waterproof function.

BACKGROUND ART

The universal series bus is a popular interface for computer peripherals to connect to each other. The standard was updated from USB 1.0/1.1 to USB 2.0 and then updated from USB 2.0 to USB 3.0. The USB 3.0 is a signal transmission standard developed from the USB 2.0. The maximum speed of the USB 3.0 is 5 gigabytes/s, but that of the USB 2.0 is only 480 megabytes/s. Currently, an electrical connector based on the USB 3.0 is compatible with an electrical connector based on the USB 2.0. That is, the electrical connector based the USB 3.0 is equipped with the same structure of the electric connector based on the USB 2.0 and additionally is configured with a plurality of pins providing functions for the USB 3.0.

And, the USB 3.0 Promoter Group has finished the specification for its new, reversible USB connector design which is called USB 3.1 Type-C connector in December, 2014. The Type-C connector is about the same size as the Micro USB connector, but it's symmetrical, which allows it to be plugged in two orientations with no ill effects. The maximum speed of the Type C is 10 gigabytes/s.

China Patent Application No. 201410395693.9, published on Nov. 19, 2014, to Zhao et al., discloses a kind of Type-C connector comprising an insulative housing, two terminal modules assembled to top and bottom surfaces of the insulative housing and a metallic shell surrounding the insulative housing and two terminal modules. In recent years, the electrical connector has been provided with additional functions (such as a waterproof function) besides a basic connection function. However, the above said Type-C connector doesn't have waterproof function.

So, an electrical connector assembly with good effectiveness of waterproof is needed.

SUMMARY OF INVENTION

Accordingly, an object of the present invention is to provide an electrical connector assembly having good effectiveness of waterproof.

In order to achieve the object set forth, an electrical connector assembly comprises an insulative housing; a plurality of terminals received into the insulative housing; a metallic shell enclosing the insulative housing; and waterproof material sandwiched between the insulative housing and the metallic shell.

In order to achieve the object set forth, a method of manufacturing an electrical connector assembly, comprises the steps of: an insulative base; a first and second terminal modules respectively assembled to top and bottom surfaces; a first insulative piece molding to a top surface of the insulative base and covering a section of first terminal module; a second insulative piece molding to a bottom surface of the insulative base and covering a section of second terminal module; a waterproof ring surrounding the insulative base and the first and second insulative pieces; and a metallic shell enclosing the insulative base, the first and second insulative pieces and pressing the waterproof ring.

In order to achieve the object set forth, a method of manufacturing an electrical connector assembly, comprises the steps of: providing an insulative base having a metallic plate formed therein; assembling a first terminal module to a top surface of the insulative base; assembling a second terminal module to a bottom surface of the insulative base; molding the first insulative piece to the top surface of the insulative base; molding the second insulative piece to the bottom surface of the insulative base; assembling a waterproof ring to an outer surface of the insulative base, a first and second insulative pieces; providing a first metallic piece surrounding the an outer surface of the insulative base, a first and second insulative pieces and pressing the waterproof ring.

Other objects, advantages and novel features of the invention will become more apparent from the following detailed description when taken in conjunction with the accompanying drawings.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

Figure 1:
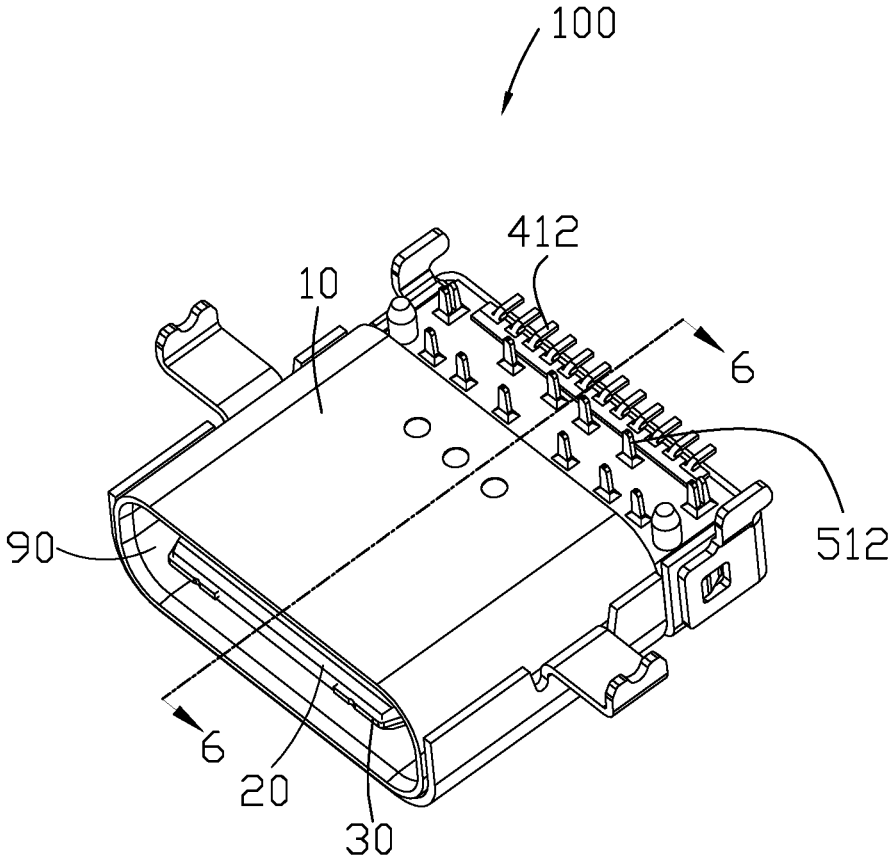
FIG. 1 is an assembled perspective view of an electrical connector assembly according to a first embodiment of the present invention.

Reference will now be made to the drawing figures to describe the embodiments of the present invention in detail. In the following description, the same drawing reference numerals are used for the same elements in different drawings.

Referring to FIGS. 1 to 4 and 6, an electrical connector assembly 100 according to a first embodiment of the present invention is assembled in a consumer electronic device (not shown in FIGS.) as an I/O port of the consumer electronic device. The electrical connector assembly 100 comprises an insulative base 21, a first terminal module 40 and a second terminal module 50 respectively formed on top and bottom surfaces of the insulative base 21, a first insulative piece 22 molding to the top surface of the insulative base 21, a second insulative piece 23 molding to the bottom surface of the insulative portion 21, a metallic clamp 80 surrounding the insulative base 21 and the first and second insulative pieces 22, 23, a metallic shell 10 enclosing the insulative base 21 and the first and second insulative pieces 22, 23 and engaged with the first and second insulative pieces 22, 23. It should be noted that the insulative base 21, the first and second insulative pieces 22, 23 can be seen as an insulative housing 20 after the insulative base 21, the first and second insulative pieces 22, 23 are formed together. In addition, the electrical connector assembly 100 further comprises a waterproof ring 60 and a waterproof glue 70 formed between the insulative housing 20 and the metallic shell 10. And, the electrical connector assembly 100 is a symmetrical USB receptacle connector having a mating port 90 which allows it to be plugged in two orientations.

Figure 2:
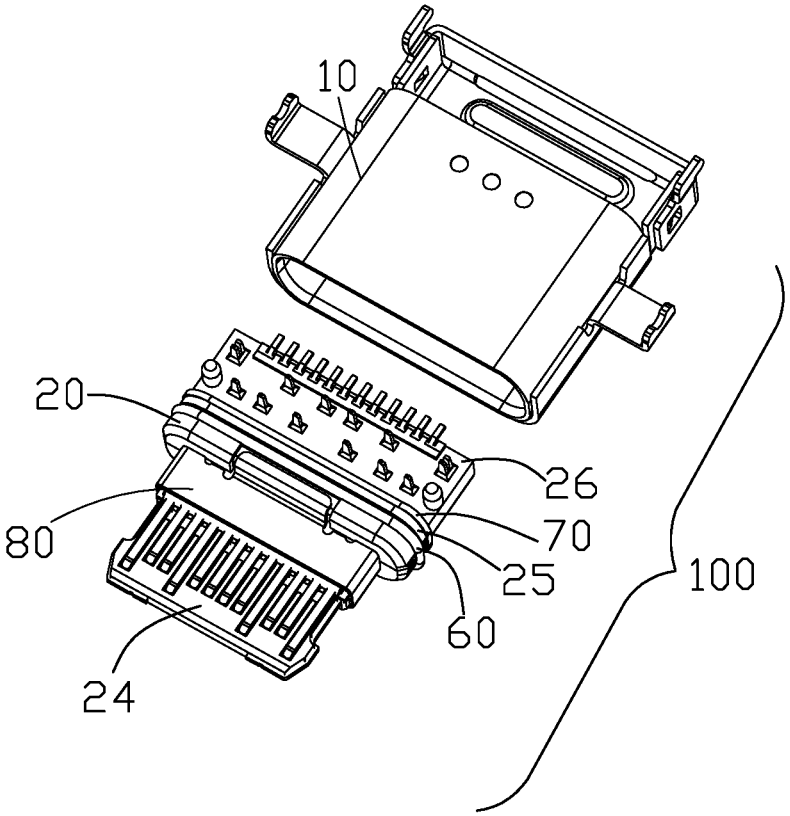
FIG. 2 is a partial assembled perspective view of the electrical connector assembly according to the first embodiment of present invention.
Figure 3:
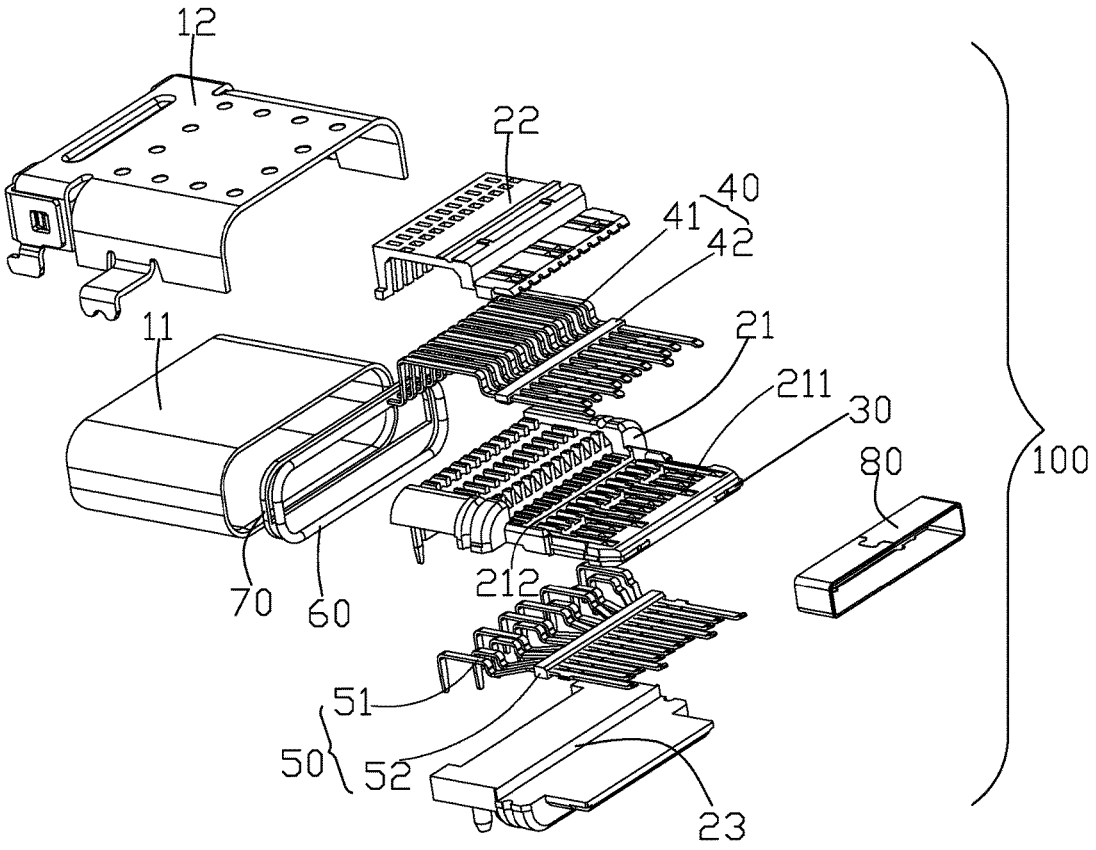
FIG. 3 is an exploded view of the electrical connector assembly according to the first embodiment of present invention.
Figure 4:
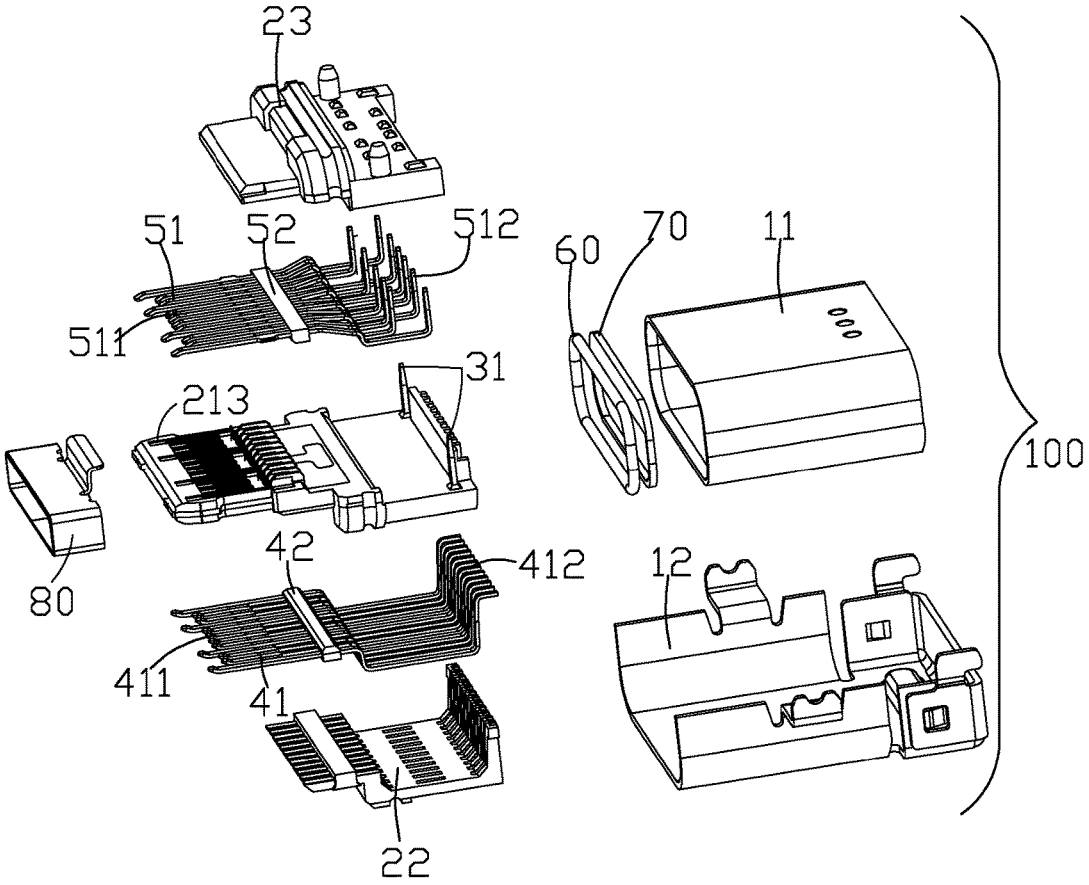
FIG. 4 is a view similar to FIG. 3, while taken from a different aspect.
Figure 5:
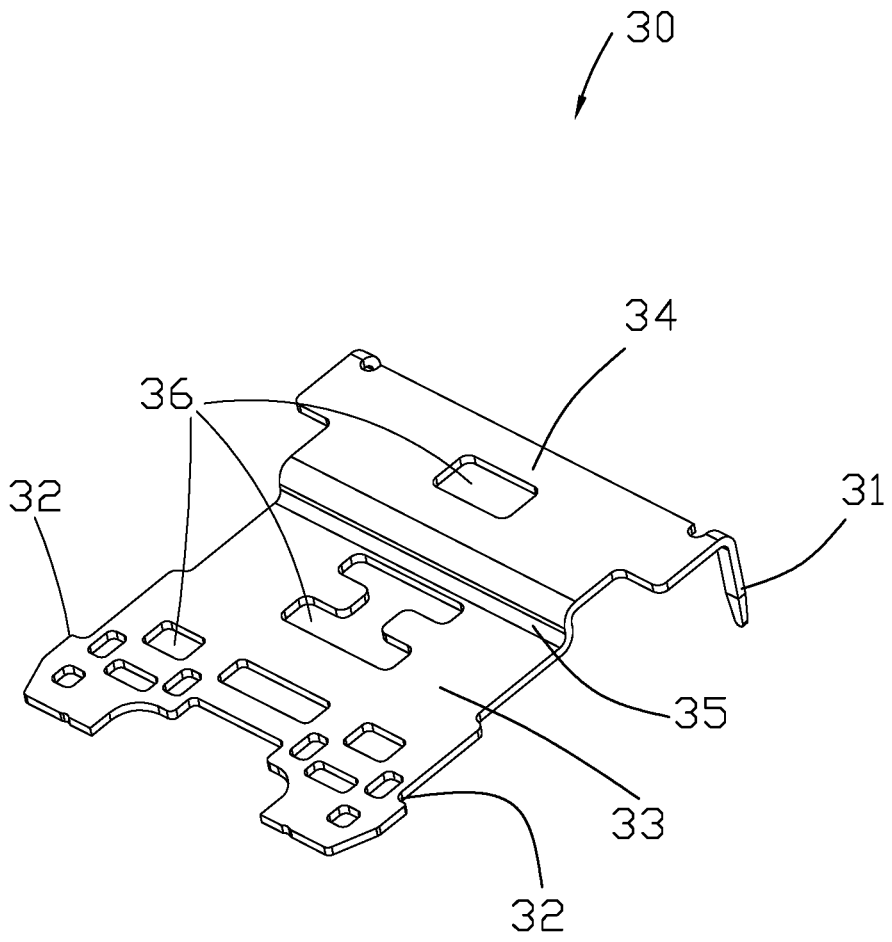
FIG. 5 is a perspective view of a metallic plate of the electrical connector assembly according to the first embodiment of present invention.

Referring to FIGS. 2 to 4, the metallic shell 10 comprises a first metallic piece 11 and a second metallic piece 12 soldered to an outer surface of the first metallic piece 11. The first metallic piece 11 is structured in a hollow pipe via a deep drawing process from a thin metallic plate. Thus, there is no slit formed on the first metallic piece 10.

Referring to FIGS. 3 and 4, a plurality of first terminal slots 211 and a groove 212 are formed on the top surface of the insulative base 21. The plurality first terminal slots 211 are extending along a longitudinal direction, the groove 212 is extending along a transversal direction and crossing with the plurality of first terminal slots 211. A plurality of second terminal slots 213 are formed on the bottom surface of the insulative base 21.

Figure 9:
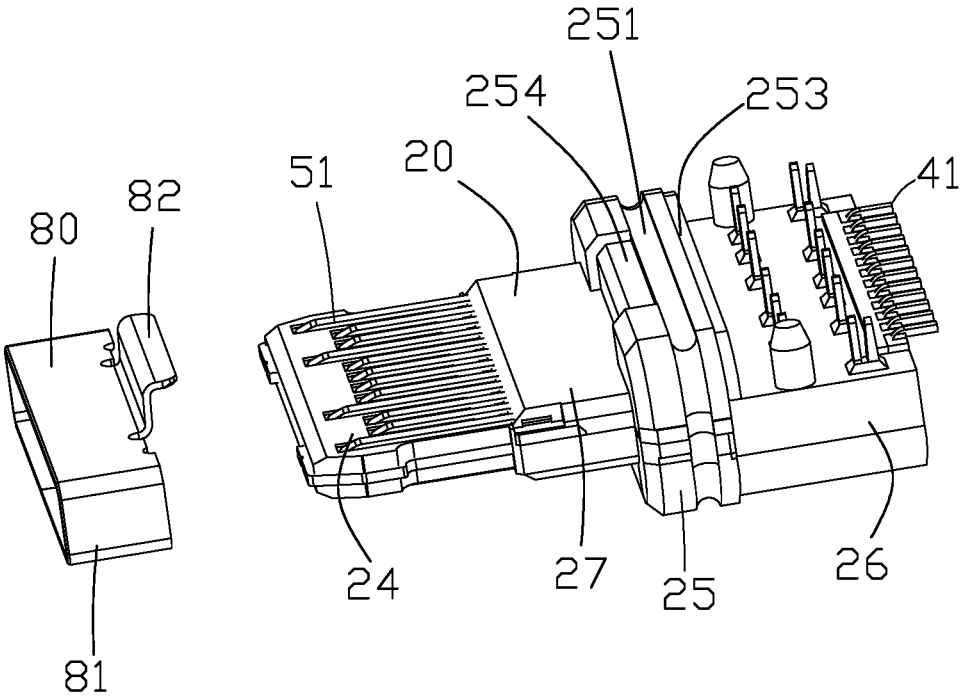
FIG. 9 is an exploded view of the insulative housing and the metallic clamp.
Figure 10:
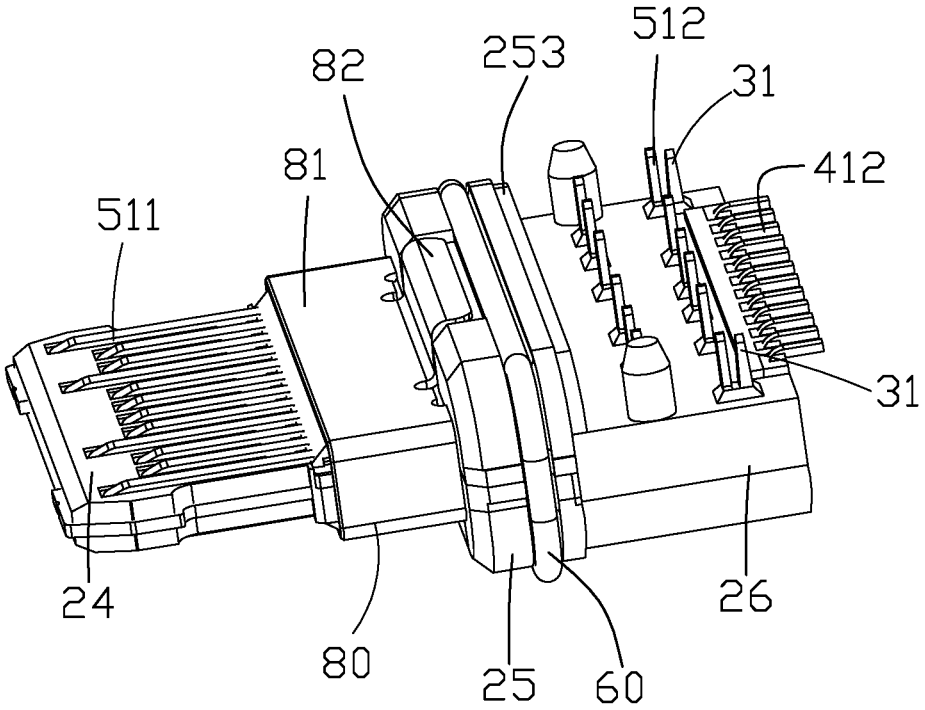
FIG. 10 is an assembled perspective view of the insulative housing and the metallic clamp.

Referring to FIGS. 2, 9 and 10, the insulative housing 20 is formed by the insulative base 21 and first and second insulative pieces 22, 23. The insulative housing 20 defines a base portion 25, a front tongue portion 24, a middle portion 27 disposed between the base portion 25 and the tongue portion 24, and a rear portion 26 extending rearwardly from the base portion 25. The base portion 25 defines a circular slot 251, a recess 253 and a groove 254. The circular slot 251 is formed on a peripheral surface of the base portion 25 and used for receiving the waterproof ring 60. The recess 253 is also formed on a peripheral surface of the base portion 25 and used for receiving the waterproof glue 70. The groove 254 is formed on a front and top surface of the base portion 25 and used for receiving a portion of the metallic clamp 80. And, the recess 253 is located behind the circular slot 251, the groove 254 is located in front of the circular slot 251.

Referring to FIGS. 3, 4, 7 and 8, the first terminal module 40 comprises a plurality of first terminals 41 arranged along a transversal direction and a first insulator 42 integrated with the plurality of first terminals 41 via insert molding process. The plurality of first terminals 41 are respectively received into the corresponding first terminal slots 211. The first insulator 42 is received into the groove 212. Each of the first terminal 41 defines a first mating portion 411 and a first soldering portion 412. The first mating portion 411 and the first soldering portion 412 are respectively located on the front and rear ends of the first terminal 41 and paralleled with each other. The first mating portion 411 and the first soldering portion 412 are both extending along a horizontal direction.

Referring to FIGS. 3, 4, 7 and 8, the second terminal module 50 comprises a plurality of second terminals 51 arranged along a transversal direction and a second insulator 52 integrated with the plurality of second terminals 51 via insert molding process. The plurality of second terminals 51 are received into the corresponding second terminal slots 213. Each of second terminal 51 defines a second mating portion 511 and a second soldering portion 512 respectively located at front and rear ends of the second terminal 51 and perpendicular with each other. The second mating portion 511 is extending along a horizontal direction. The second soldering portion 512 is extending along a vertical direction.

Referring to FIGS. 5 to 10, the electrical connector assembly 100 further comprises a metallic plate 30 formed in the insulative base 21 and located between the first and second terminal module 40, 50. The metallic plate 30 is used to reinforce the tongue portion 24 of the insulative housing 20 and for reducing cross talk and electromagnetic interference when the first and second terminals 41, 51 are in high-speed signal transmission. The metallic plate 30 comprises a horizontal body portion 33, a horizontal rear portion 34 and a vertical connecting portion 35 connected with the body portion 33 and the rear portion 34. The metallic plate 30 defines a plurality of positioning holes 36 for firmly combining with the insulative base 21. The body portion 33 defines two latching portions 32 extending outwardly from two sides of the insulative base 21 for latching with a complementary connector (not shown in FIGS.). The rear portion 34 defines two third soldering portions 31 extending along a vertical direction and extending out of the insulative housing 20. The two third soldering portions 31 are paralleled with the plurality of second soldering portions 512. And, the metallic plate 30 can be electrically contacted with an outside grounding loop to achieve a good effectiveness of cross talk prevention and EMI suppression for the electrical connector assembly 100.

Figure 6:
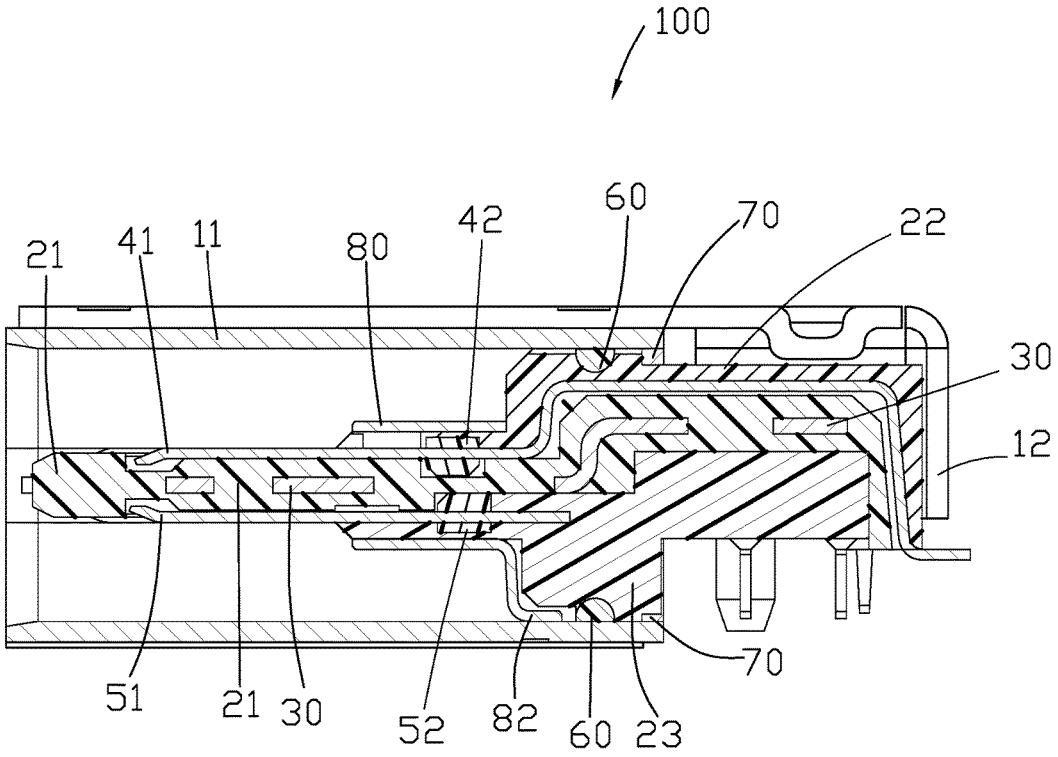
FIG. 6 is a cross-sectional view of the electrical connector assembly according to the first embodiment of the present invention taken along line 6-6 of FIG. 1.
Figure 7:
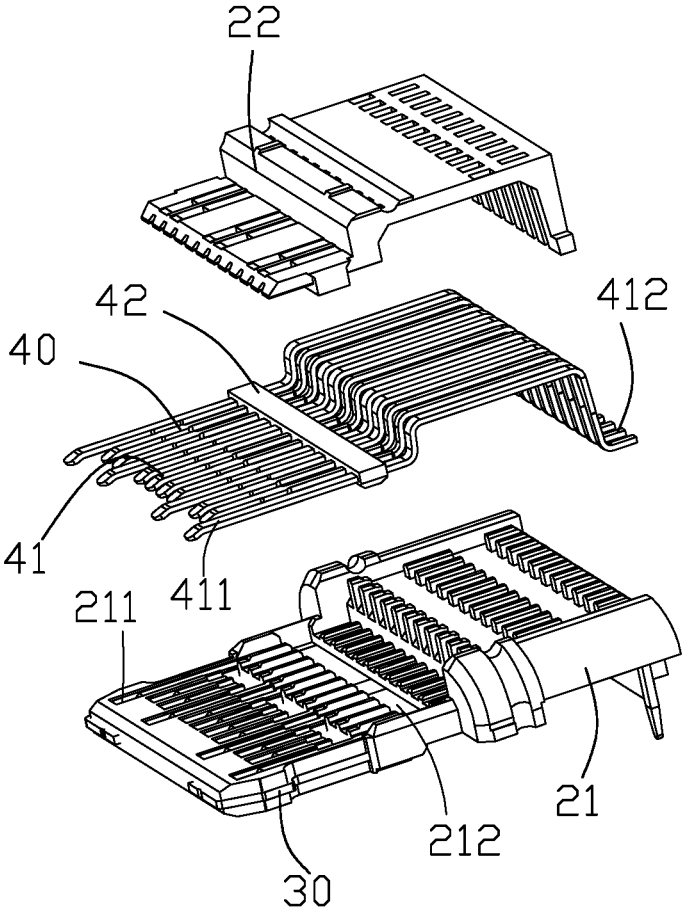
FIG. 7 is an exploded view of an insulative base, a first terminal module and a first insulative piece of the electrical connector assembly according to the first embodiment of present invention.
Figure 8:
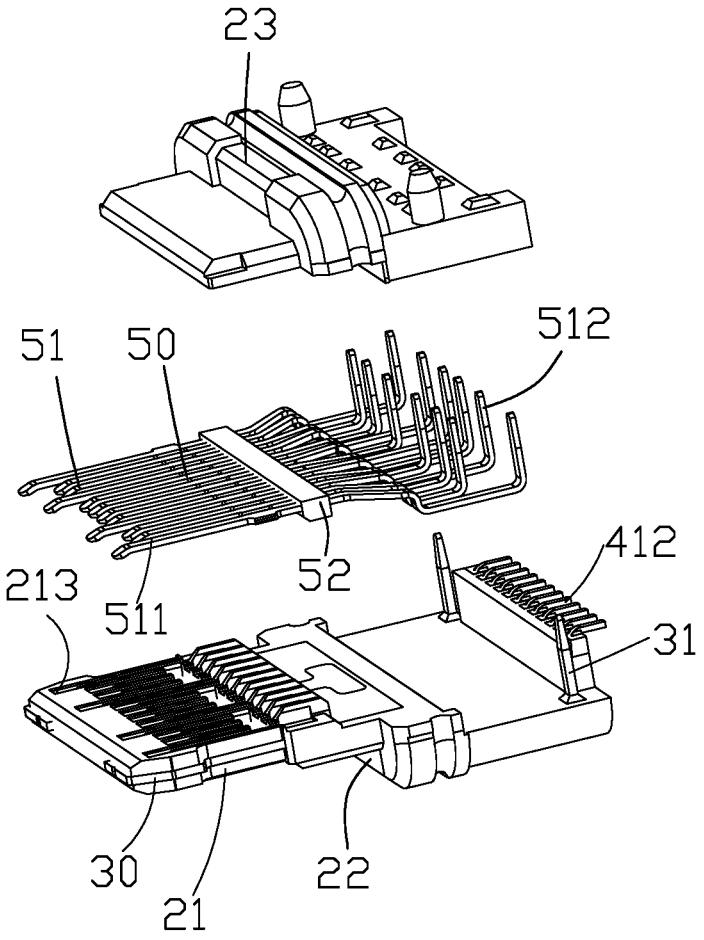
FIG. 8 is an exploded view of an insulative base integrated with the first terminal module and the first insulative piece, a second terminal module and a second insulative piece of the electrical connector assembly according to the first embodiment of present invention.

Referring to FIGS. 6 and 10, the waterproof ring 60 is structured in a circular shape and made of insulative and elastic material. The waterproof ring 60 is received into the circular slot 251 and sandwiched between the insulative housing 20 and the metallic shell 10. So, there is no gap formed between the insulative housing 20 and the metallic shell 10 due to the waterproof ring 60. As a result, the water will not enter into an inner space of the electronic device through the mating port 90 of the electrical connector assembly 100 due to the waterproof ring 60.

Figure 11:
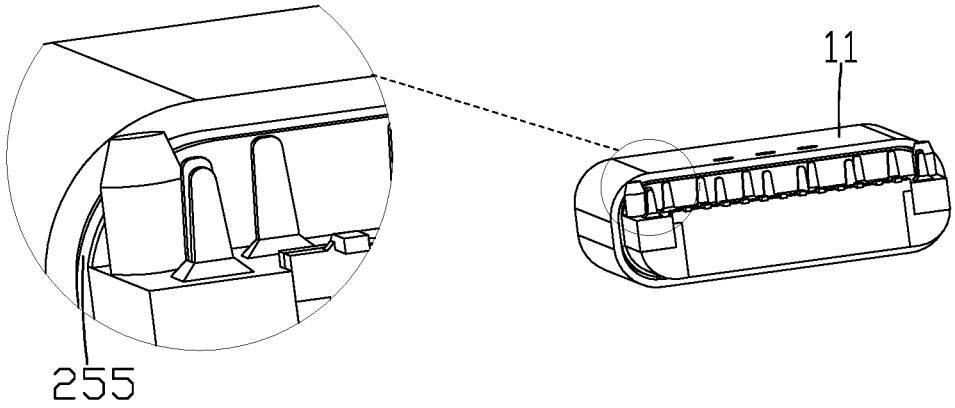
FIG. 11 is an assembled perspective view of the electrical connector assembly without a second metallic piece according to the first embodiment of present invention and a partial enlarged view to show a receiving slot formed in the electrical connector assembly.
Figure 12:
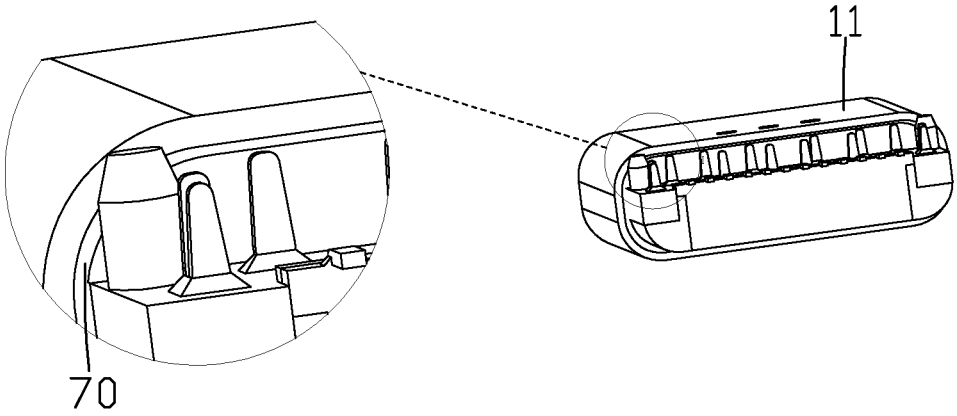
FIG. 12 is an another assembled perspective view of the electrical connector assembly with waterproof glue formed in the receiving slot shown in FIG. 11.

Referring to FIGS. 6, 11 and 12, the electrical connector assembly 100 further comprises the waterproof glue 70 filled into a receiving slot 255 which is formed between the insulative housing 20 and the first metallic piece 11 of the metallic shell 10. After the first metallic piece 11 is assembled to the insulative housing 20, thus, the receiving slot 255 is formed. And the receiving slot 255 is located behind the circular slot 251 along a mating direction of the electrical connector assembly 100. So, the electrical connector assembly 100 will have better waterproof function due to the additional waterproof glue 70.

Referring to FIGS. 2 to 4, 6, 9 and 10, the metallic clamp 80 is structured in circular shape and surrounding the middle portion 27. The metallic clamp 80 comprises a circular base portion 81 enclosing the middle portion 27 and a connecting portion 82 received into the groove 254 and attached to an inner surface of the first metallic piece 11 of the metallic shell 10. Thus, the connecting portion 82 can be soldered to the first metallic piece 11. As a result, the metallic clamp 80 is positioned with the metallic shell 10.

Referring to FIGS. 1 to 12, the manufacturing process of the electrical connector assembly 100 made in according to the first embodiment of the present invention starts from providing an insulative base 21 with a metallic plate 30 formed therein.

Then, assemble the first and second terminal modules 40, 50 respectively to the top and bottom surfaces of the insulative base 21. Thus, the metallic plate 30 is located between the first and second terminal modules 40, 50.

Then, mold the first and second insulative pieces 22, 23 respectively to the top and bottom surfaces of the insulative base 21. A middle and rear portion of the first and second terminal modules 40, 50 are covered by the first and second insulative pieces 22, 23. The first and second mating portions 411, 511 of the plurality of first and second terminals 41, 51 are respectively received into the first and second terminal slots 211, 213 and not covered by the first and second insulative pieces 22, 23. The first and second soldering portions 412, 512 of the plurality of first and second terminals 41, 51 are both extending out of by the first and second insulative pieces 22, 23. After the first and second insulative pieces 22, 23 are formed to the insulative base 21, the insulative housing 20 is formed.

Then, assemble the metallic clamp 80 to middle portion 27 of the insulative housing 1. The circular base portion 81 encloses the middle portion 27, and the connecting portion 82 is received into the groove 254.

Then, assemble the waterproof ring 60 to the circular slot 251.

Then, assemble the first metallic piece 11 to the insulative housing 20. The tongue portion 24, the middle portion 27 and the base portion 25 are all enclosed by the first metallic piece 11. The waterproof ring 60 is sandwiched between the first metallic piece 11 and the insulative housing 20. As the recess 253 is existed on a rear edge of the base portion 25, so the receiving slot 255 is formed between the first metallic piece 11 and the insulative housing 20. And, the mating port 90 is also formed when the first metallic piece 11 is assembled to the insulative housing 20.

Then, put the waterproof glue 70 into the receiving slot 255.

Finally, assemble the second metallic piece 12 to the first metallic piece 11. The second metallic piece 12 is soldered to the first metallic piece 11. Thus, the metallic shell 10 is formed by the first and second metallic pieces 11, 12.

After the above assembling steps, the entire process of manufacturing of the electrical connector assembly 100 made in according to the first embodiment of the present invention is finished.

Figure 13:
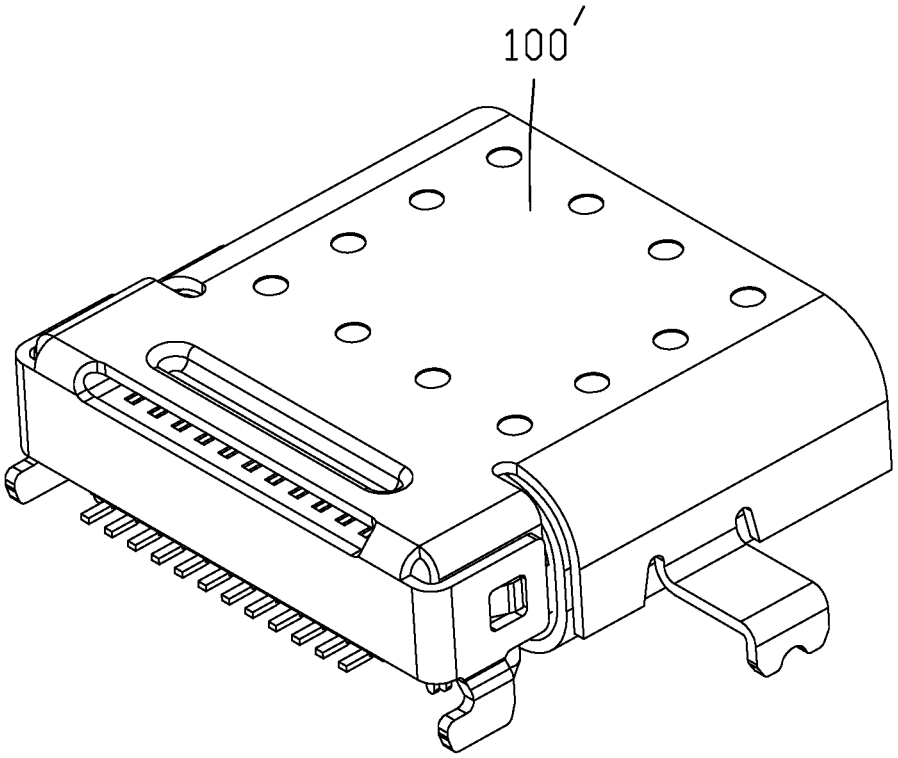
FIG. 13 is a perspective view of an electrical connector assembly according to a second embodiment of present invention.
Figure 14:
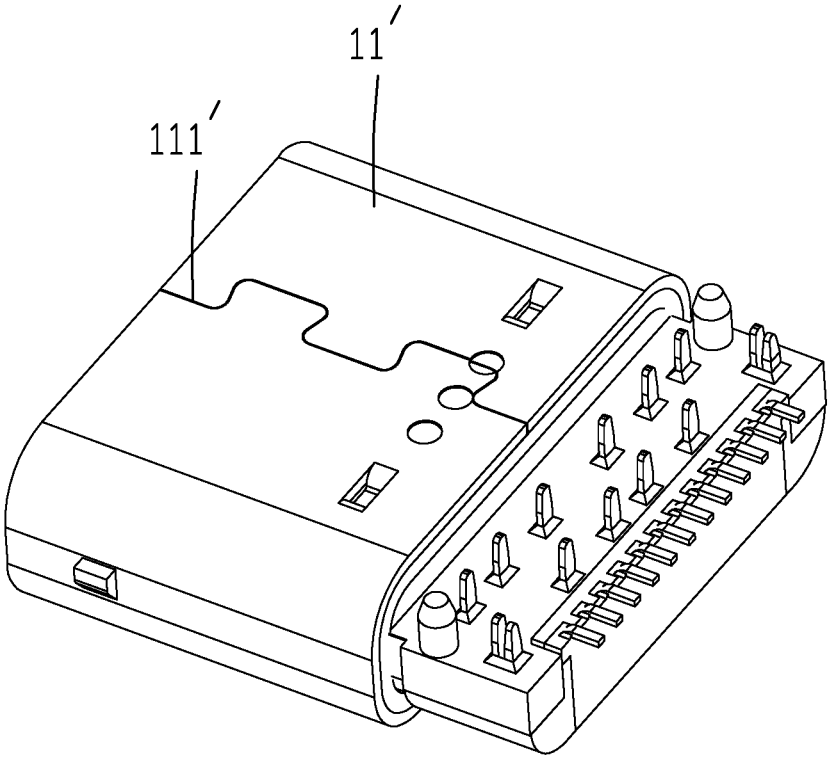
FIG. 14 is a perspective view of an electrical connector assembly without a second metallic piece according to the second embodiment of present invention.
Figure 15:
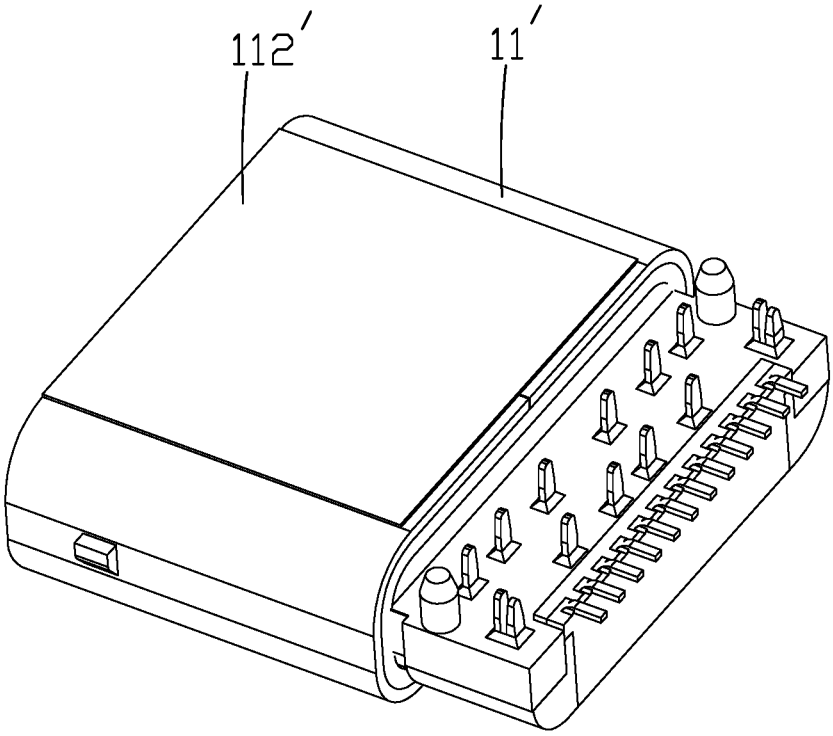
FIG. 15 is another perspective view of the electrical connector assembly with a waterproof tape pasted on a first metallic piece shown in FIG. 14.

Referring to FIGS. 13 to 15, an electrical connector assembly 100' according to the second embodiment of the present invention has a similar structure with the electrical connector assembly 100. However, the electrical connector assembly 100' comprises a metallic shell 10' having a first metallic piece 11' different from the first metallic piece 11 of the metallic shell 10. Actually, the metallic piece 11' is formed by stamping and bending process. So, the metallic piece 11' defines a slit 111' on a side wall thereof. To avoid water enter into the consumer electronic device through the slit 111', an additional waterproof tape 112' is pasted to the side wall to seal the slit 111' to prevent water from flowing into the inner space of the electronic device through the slit 111'. And, the manufacturing process of the electrical connector assembly 100' made in according to the second embodiment of the present invention is same with that of the electrically assembly 100, so the manufacturing process of the electrical connector assembly 100' will not be detailed described here.

Actually, the electrical connector assembly 100, 100' has a good waterproof function due to the waterproof ring 60 and waterproof glue 70 sandwiched between the insulative housing 20 and the metallic shell 10, 10'. So, the gap between the insulative housing 20 and the metallic shell 10, 10' is sealed by the waterproof ring 60 and waterproof glue 70. Thus, water or other liquid will not enter into the consumer electronic device through the mating port 90 of the electrically connector assembly 100, 100'. On the other hand, the electrical connector assembly 100, 100 is also easily manufactured. And, a method of manufacturing the electrical connector assembly 100, 100 is efficiency and accuracy.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing;

a plurality of terminals received into the insulative housing;

a metallic shell enclosing the insulative housing; and waterproof material sandwiched between the insulative housing and the metallic shell, and a metallic clamp enclosing a portion of the insulative housing and is connected with the metallic shell;

wherein the insulative housing defines a base portion, a front tongue portion, a middle portion disposed between the base portion and the front tongue portion, and a rear portion;

wherein the base portion defines a circular slot, a recess and a groove, the circular slot receives the waterproof material, the recess receives another waterproof material, so as to form a double waterproof structure, the groove receives a portion of the metallic clamp, the recess is located behind the circular slot, and the groove is located in front of the circular slot.

2. The electrical connector assembly as recited in claim 1, wherein the metallic clamp is enclosing the middle portion and soldered with the metallic shell.

3. The electrical connector assembly as recited in claim 1, wherein waterproof material comprises a waterproof ring and a water proof glue spaced with each other along a mating direction of the electrical connector assembly.

4. The electrical connector assembly as recited in claim 1, wherein the electrical connector assembly further comprises a metallic plate formed in the insulative housing.

5. The electrical connector assembly as recited in claim 4, wherein a plurality of first terminal define a plurality of front mating portions extending to a top surface of the insulative housing, a plurality of second terminals define a plurality of front mating portions formed on a bottom surface of the insulative housing.

6. The electrical connector assembly as recited in claim 1, wherein the metallic shell comprises a first metallic piece and a second metallic piece soldered to the first metallic piece.

7. The electrical connector assembly as recited in claim 6, wherein the first metallic piece is structured in a hollow pipe via a deep drawing process from a thin metallic plate, such that no slit is formed on the first metallic piece.

8. An electrical connector assembly comprising:

an insulative base;

a first and second terminal modules respectively assembled to top and bottom surfaces;

a first insulative piece molded to a top surface of the insulative base and covering a section of first terminal module;

a second insulative piece molded to a bottom surface of the insulative base and covering a section of second terminal module;

a waterproof ring surrounding the insulative base and the first and second insulative pieces;

a metallic shell enclosing the insulative base, the first and second insulative pieces and pressing the waterproof ring; and a metallic clamp enclosing the insulative base and the first and second insulative pieces, wherein the metallic clamp is connected with the metallic shell;

wherein an insulative housing is formed by the insulative base, the first insulative piece and the second insulative piece and the insulative housing defines a base portion, a front tongue portion, a middle portion disposed between the base portion and the front tongue portion, and a rear portion;

wherein the base portion defines a circular slot, a recess and a groove, the circular slot receives the waterproof ring, the recess receives waterproof glue, so as to form a double waterproof structure, the groove receives a portion of the metallic clamp, the recess is located behind the circular slot, and the groove is located in front of the circular slot.

9. The electrical connector assembly as recited in claim 8, wherein the electrically connector assembly further comprises the waterproof glue disposed between the metallic shell and the insulative base, the first and second insulative pieces, and the waterproof glue is put into the recess.

10. The electrical connector assembly as recited in claim 8, wherein the electrical connector assembly further comprises a metallic plate formed in the insulative housing.

11. The electrical connector assembly as recited in claim 8, wherein the first terminal module comprise a plurality of first terminals and a first insulator integrated with the plurality of first terminals, the second terminal module comprises a plurality of second terminals and a second insulator integrated with the plurality of second terminals.

12. The electrical connector assembly as recited in claim 8, wherein the electrical connector assembly is a USB Type C connector.

13. A method of manufacturing an electrical connector assembly, comprising the steps of:

providing an insulative base having a metallic plate formed therein;

assembling a first terminal module to a top surface of the insulative base;

assembling a second terminal module to a bottom surface of the insulative base;

molding a first insulative piece to the top surface of the insulative base;

molding a second insulative piece molded to a bottom surface of the insulative base;

assembling a waterproof ring to an outer surface of the insulative base, and the first and second insulative pieces;

providing a first metallic piece surrounding the outer surface of the insulative base, the first and second insulative pieces and pressing the waterproof ring;

providing a metallic clamp surrounding the insulative base and the first and second insulative pieces; and connecting the metallic clamp with the metallic piece;

wherein an insulative housing is formed by the insulative base, the first insulative piece and the second insulative piece and the insulative housing defines a base portion, a front tongue portion, a middle portion disposed between the base portion and the front tongue portion, and a rear portion;

wherein the base portion defines a circular slot, a recess and a groove, the circular slot receives the waterproof ring, the circular slot receives waterproof glue, so as to form a double waterproof structure, the groove receives a portion of the metallic clamp, the recess is located behind the circular slot, and the groove is located in front of the circular slot.

14. The method of manufacturing the electrical connector assembly as recited in claim 13, further comprising the step of:

pasting a waterproof tape to a side surface of the first metallic piece.

15. The method of manufacturing the electrical connector assembly as recited in claim 14, further comprising the step of:

providing the waterproof glue into a receiving slot of the recess formed between the first metallic piece and the first and second insulative pieces.

16. The method of manufacturing the electrical connector assembly as recited in claim 14, further comprising the step of:

soldering a second metallic piece to the first metallic piece.

* * * * *